US006290223B1

(12) United States Patent
Roux et al.

(10) Patent No.: US 6,290,223 B1
(45) Date of Patent: Sep. 18, 2001

(54) DEVICE FOR SUPPLYING FLAT PRODUCTS TO A PROCESSING STATION

(75) Inventors: Jean Roux, Vernes; Jean-Luc Bardet, Nods; Pierre-André Lautenschlager, Le Rafour, all of (CH)

(73) Assignee: Axiome Alpha S.A. (CH)

( * ) Notice: Subject to any disclaimer, the term of this patent is extended or adjusted under 35 U.S.C. 154(b) by 0 days.

(21) Appl. No.: 09/445,949

(22) PCT Filed: Jun. 15, 1998

(86) PCT No.: PCT/CH98/00259

§ 371 Date: Mar. 14, 2000

§ 102(e) Date: Mar. 14, 2000

(87) PCT Pub. No.: WO98/58862

PCT Pub. Date: Dec. 30, 1998

(30) Foreign Application Priority Data

Jun. 19, 1997 (FR) ..... 97 07811

(51) Int. Cl.[7] ..... B65H 5/00

(52) U.S. Cl. ..... 271/10.03; 271/10.11; 271/149

(58) Field of Search ..... 271/10.11, 10.09, 271/10.03, 10.01, 149, 126, 121, 117, 118

(56) References Cited

U.S. PATENT DOCUMENTS 4,640,602 * 2/1987 Redding et al. .
4,795,145 * 1/1989 Fuller .
5,836,581 * 11/1998 Vernackt .

FOREIGN PATENT DOCUMENTS

2546820 * 12/1984 (FR) .
7-172597 * 7/1995 (JP) .

* cited by examiner

*Primary Examiner*—David H. Bollinger
(74) *Attorney, Agent, or Firm*—Baker Botts L.L.P.

(57) ABSTRACT

Device for individually supplying flat products (P) to a processing station, including a feed attachment (2) having a wall (4) with substantially vertical orientation, against which the products are juxtaposed, and a system (16) for extracting the products to feed them one by one to the processing station. the extraction system includes a mechanism (18) for applying a force to press against the wall the product (P1) which is nearest thereto, a mechanism (40) for driving the nearest product to move it upwards, a grasping mechanism (42) for loading the product when it has been moved over a predetermined distance by the driving mechanism, a device (72) for detecting the loading of the product by the grasping mechanism, and a controller (28) responding to the detection signal to control the force applying mechanism so that it exerts the force as long as the product has not been loaded by the grasping mechanism and ceases applying the force as soon as the product has been loaded, so as to cause the products other than the product in contact with the wall to fall back into the feed attachment. Application is to the feeding of paper sheets or cards to a scanner, reader, a computer peripheral or a printer.

21 Claims, 2 Drawing Sheets

DEVICE FOR SUPPLYING FLAT PRODUCTS TO A PROCESSING STATION

The present invention concerns a device for individually feeding flat products, such as sheets of paper or cards to a processing station, for example a scanner, a reader, a computer peripheral or a printer.

The invention concerns more particularly a device of this type in which the products to be supplied are not stacked, but are juxtaposed inside a vertical feed attachment.

Feed devices with vertical feed attachments, wherein the sheets are evacuated downwards via the effect of gravity, are already known, in particular from French Patent No. 2 546 820 and Japanese Patent No. 7 172 597. However, these devices have the drawback that several sheets are liable to be fed simultaneously to the processing station, which can cause the device or processing station to jam. In the absence of such a jam, the simultaneous feeding of several sheets has the effect of concealing the sheets driven simultaneously with the first sheet of the pile. They can thus not be processed, which, particularly in the case of feeding a scanner, is a major drawback.

The object of the present invention is to overcome the drawbacks of the aforementioned prior art by providing a device which allows only one product to be fed at a time.

The device according to the invention thus concerns a feed attachment having a wall with substantially vertical orientation, against which the products are juxtaposed, and a system for extracting said products to feed them one by one to the processing station. This device is principally characterised in that the extraction system includes:

means for applying a force to press against said wall the product which is nearest thereto, means for driving said nearest product to move it upwards, grasping means for loading said product when it has been moved over a predetermined distance by said driving means, means for detecting the loading of the product by said grasping means, these detection means being capable of supplying a detection signal and control means responding to said detection signal to give a command to said applying means to exert said force as long as the product has not been loaded by the grasping means and to cease applying said force as soon as the product has been loaded, so as to cause the products other than the product in contact with the wall to fall back into the feed attachment.

Figure 1:
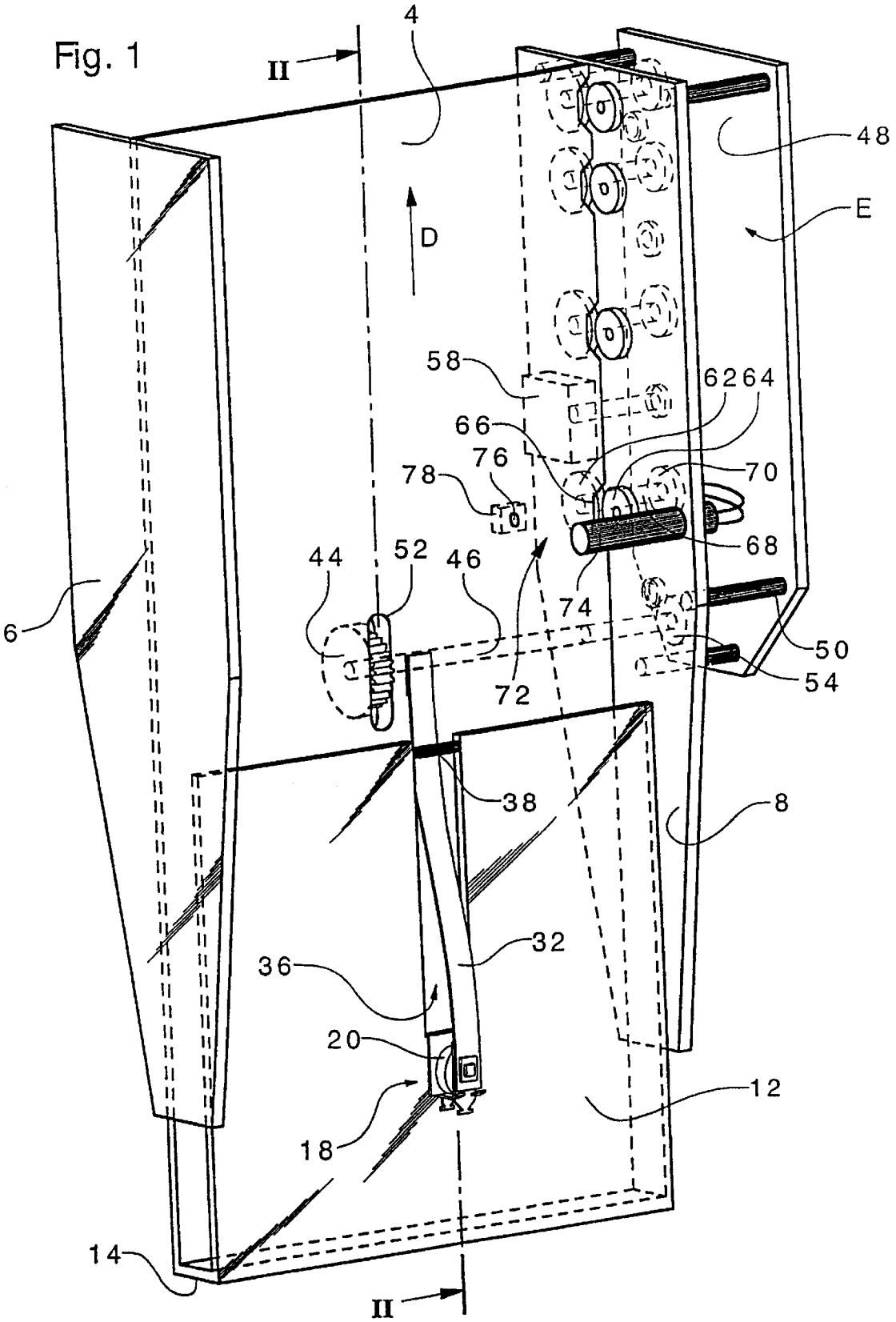
Figure 2:
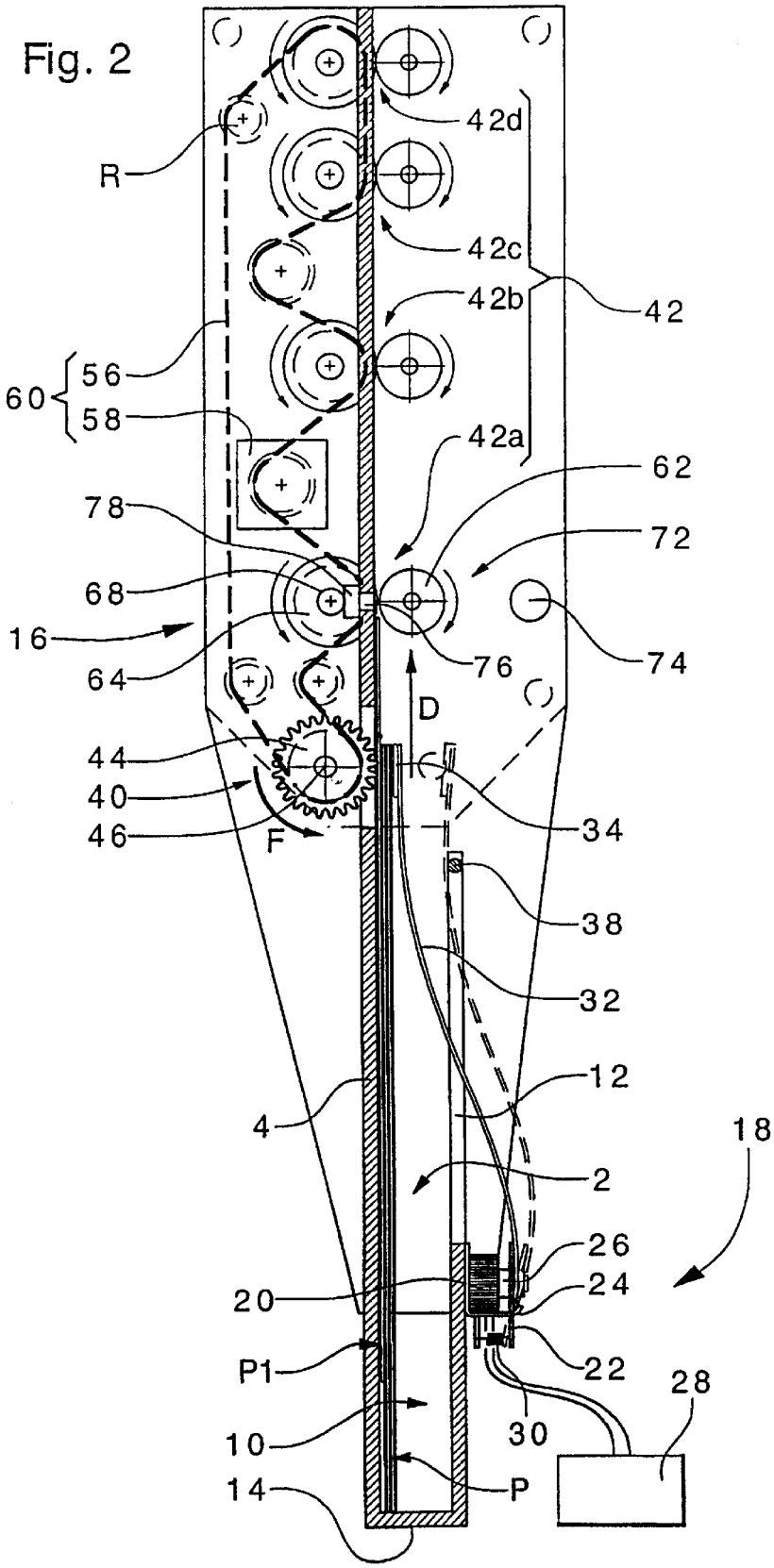

Other features and advantages of the invention will appear upon reading the following detailed description, made with reference to the annexed drawings which are given solely by way of example, and in which:

FIG. 1 is a schematic perspective view of an embodiment of the device according to the invention, and FIG. 2 is a cross-section of the device, along the line II—II of FIG. 1.

With reference now to the Figures, an embodiment of the device according to the invention is illustrated.

This device is intended to feed flat products P, such as sheets of paper or cards, to a processing station, for example a scanner, a reader, a computer peripheral or a printer, which is not shown.

The device includes a feed attachment 2 in which products P are stored. This feed attachment 2 has a wall 4 with substantially vertical orientation and two lateral walls 6 and 8. It is provided with a container 10 which is formed of a wall 12 extending opposite wall 4 and a bottom 14 connecting walls 4 and 12.

Inside feed attachment 2, products P are juxtaposed against wall 4 and rest via one of their edges (not shown) on bottom 14.

According to the invention, wall 4 is oriented so that, solely via the action of gravity, products P can fall back into feed attachment 2 to rest on bottom 14.

Preferably wall 4 is oriented vertically, but it will be understood that it can be inclined with respect to the vertical by an angle determined by the friction coefficient between products P and the surface of the wall.

The device further includes an extraction system, designated by the general reference 16, which allows products P to be fed upwards one by one to a processing station, not shown, arranged downstream.

Extraction system 16 includes means 18 for applying force, in the direction of wall 4, over all products P. These means include an electromagnet 20 fixed onto wall 12. A plate 22 is mounted in an articulated manner at 24 on the armature of the electromagnet facing its core 26 to which it is attracted (position shown in full lines) when it is being supplied electrically by control means 28. A return spring 30 acts upon the lower end of this plate so as to move it away from core 26 (position shown schematically in a dotted line in FIG. 2) as soon as the electromagnet is no longer being electrically supplied. An elastic strip 32, bent towards wall 4, is fixed to plate 22 by its lower end and carries at its upper end a pad 34 which is applied onto products P so as to press them against wall 4 when the electromagnet is supplied. This pad is made of polyurethane or any other material allowing the "pad on product P" friction to be slightly greater than the "product on product" friction. In order to allow strip 32 to pass, a scalloping 36 is arranged in wall 12. Finally, a stop 38, fixed in said scalloping, is used to limit the travel of the strip when, via the action of return spring 30, it is in the open position (FIG. 2), i.e. at a distance from products P.

Extraction system 16 further includes means 40 for driving product P1 nearest to wall 4 upwards in the direction of grasping means 42.

Driving means 40 include a roller 44 positioned, preferably, substantially opposite pad 34 of strip 32. This roller 44 is rotatably mounted on a shaft 46 which extends transversely to the direction D of movement of products P in the device. In the example shown, shaft 46 is guided in rotation by wall 8 and an outer plate 48 which delimit between them a gap E. Plate 48 extends parallel to wall 8 and its fixed thereto via struts 50 only one of which has been referenced.

Wall 4 includes an oblong opening 52 through which roller 44 projects to come into contact with product P1 which is subjected to the action of pad 34. This roller preferably has a toothed outer periphery, not referenced, provided to improve the driving of products P and made, for example, of a synthetic material, particularly an elastomeric material, such as silicon. The periphery of the roller is thus formed of a plurality of short flexible strips with a high friction coefficient.

Of course, roller 44 may also have a smooth periphery, provided that the material of such periphery has sufficient properties for driving products P.

Shaft 46 carries, in the portion thereof extending into gap E, a pulley 54 which engages with a belt 56 driven in rotation by an electric motor 58, belt 56 not being shown in FIG. 1. Belt 56 and motor 58 form the motor means 60 for roller 44.

Grasping means 42 include a pair 42*a* of rollers 62 and 64 arranged in contact with each other, on the path of movement of products P, on each side of wall 4. The latter includes, for this purpose, opposite the two rollers, an opening 66 through which pad 64 penetrates. Pad 62 is mounted so as to rotate freely on a shaft attached to wall 8, while pad 64 is fixed onto a shaft 68 which extends into gap E and which is guided in rotation by wall 8 and plate 48.

Shaft 68 carries a pulley 70 which also engages with belt 54 and which is thus also driven by motor means 60.

The device further includes, on the path of movement of products P, three other pairs of rollers, referenced 42*b*, 42*c* and 42*d*, mounted and driven in an identical way to pair 42*a* of rollers 62 and 64.

In the example shown, these four pairs of rollers 42*a* to 42*d* form grasping means 42, but it will be understood that, in other more simplified or more elaborate alternative embodiments of the device, a higher or lower number of pairs of rollers could be provided.

Belt 56 further co-operates, in a conventional manner, with return pulleys R (only one of which has been referenced) mounted so as to rotate freely in gap E.

Extraction system 16 further includes means 72 for detecting the loading of products P by grasping means 42. More particularly, these detection means 72 act in the vicinity of the first pair of rollers 42*a*.

For this purpose, means 72 include a light source 74 advantageously formed by a photoemission diode (LED), arranged opposite the pair of rollers 42*a*, in the path of movement of products P and fixed to wall 8. Opposite source 74, wall 4 is pierced with an opening 76 behind which is mounted a light detector 78, formed, for example, by a photodiode.

The passage of a product, in particular P1, between source 74 and detector 78 interrupts the light beam emitted by the source towards the detector which then supplies to control means 28 a signal indicating detection of the grasping of product P1 by rollers 62 and 64.

The operation of the device will now be described.

Products P are introduced into feed attachment 2 in a substantially vertical position and are stored in container 10 while waiting to be extracted from the device.

Electromagnet 20, driven by control means 28, applies products P against wall 4, via elastic strip 32, so that product P1 is in close contact with roller 44 driven in rotation in the direction of arrow F. Product P1 is then moved upwards, in the direction of rollers 62 and 64 of the grasping means.

At the moment when product P1 is introduced between rollers 62 and 64, it is loaded by the latter and driven upwards. This loading is detected by detection means 72 which then supply a signal to control means 28, which in turn command electromagnet 20 to cease exerting force on products P via strip 32. The other products P, in particular those which are immediately behind product P1, are released. Thus, if products other than product P1 have been inadvertently moved, they fall back by the effect of their own weight onto bottom 14 of container 10.

According to a first variant of this extraction method, spring 30 causes elastic strip 32 to be set in an open position for a predetermined period of time (delay time) then again, via the action of control means 28, applies products P against wall 4. During this time, product P1 continues its movement upwards via the action of the other pairs of rollers 42*b*–42*d* until it is extracted from the device.

According to a second variant, spring 30 causes elastic strip 32 to be set in an open position until the moment at which detection means 72 announce the release of product P1.

Thus, it will be understood from the foregoing that control means 28 respond to the signal emitted by detection means 72 by giving electromagnet 20 of means 18 the command to exert a force on products P as long as product P1 has not been loaded by grasping means 42 and to cease applying such force as soon as it is loaded so as to cause products P other than product P1, which may have been moved towards grasping means 42 via the action of driving means 40, to fall back into container 10.

By way of additional precaution, in order to guarantee that only product P1 will be sent towards grasping means 42, a known active separation system (not shown) may be arranged between the latter and driving means 40, said system being formed of two rollers mounted in the same manner as those of the grasping means, the roller arranged on the side of wall 4 rotating in the direction which drives product P1 upwards and the other roller rotating in the opposite direction so as to push downwards any second product accompanying product P1.

What is claimed is:

1. Device for individually supplying flat products (P) to a processing station, including a feed attachment (2) having a wall (4) with substantially vertical orientation, against which the products are juxtaposed, and a system (16) for extracting said products to feed them one by one to the processing station, characterised in that the extraction system includes:

means (18) for applying a force to press against said wall the product (P1) which is nearest thereto, means (40) for driving said nearest product to move it upwards, grasping means (42) for loading said product when it has been moved over a predetermined distance by said driving means, means (72) for detecting the loading of the product by said grasping means, these detection means being capable of supplying a detection signal and control means (28) responding to said detection signal to control said applying means so that they exert said force as long as the product has not been loaded by the grasping means and cease applying said force as soon as the product has been loaded, so as to cause the products other than the product in contact with the wall to fall back into the feed attachment.

2. Device according to claim 1, characterised in that said applying means (18) include an elastic strip (32) which applies the products against said wall and an electromagnet (20) driven by said control means (28) and actuating said elastic strip.

3. Device according to claim 2, characterised in that said roller (44) is positioned substantially opposite the place where the strip (32) applies a force onto the products.

4. Device according to claim 3, characterised in that said roller (44) projects through an opening (52) arranged in said wall (4).

5. Device according to claim 3, characterised in that said roller (44) h a toothed outer periphery.

6. Device according to claim 3, characterised in that said roller (44) is connected to said motor means (60) via a belt (56).

7. Device according to claim 1, characterised in that said driving means (40) include at least one driver roller (44) and motor means (60) for driving said roller in rotation.

8. Device according to any of claim 7, characterised in that said roller (44) projects through an opening (52) arranged in said wall (4).

9. Device according to claim 8, characterised in that said roller (44) has a toothed outer periphery.

10. Device according to claim 8, characterised in that said roller (44) is connected to said motor means (60) via a belt (56).

11. Device according to any of claim 7, characterised in that said roller (44) has a toothed outer periphery.

12. Device according to claim 11, characterised in that the periphery of said roller (44) is made of elastomeric material.

13. Device according to claim 11, characterised in that at least one of said rollers (64) is driven in rotation by said belt (56).

14. Device according to claim 13, characterised in that said detector (78) is of the optical type.

15. Device according to claim 12, characterised in that at least one of said rollers (64) is driven in rotation by said belt (56).

16. Device according to any of claim 7, characterised in that said roller (44) is connected to said motor means (60) via a belt (56).

17. Device according to claim 16, characterised in that at least one of said rollers (64) is driven in rotation by said belt (56).

18. Device according to claim 7, characterised in that said roller (44) is positioned substantially opposite the place where the strip (32) applies a force onto products.

19. Device according to claim 1, characterised in that said grasping means (42) include two rollers (62, 64) arranged facing each other and motor means (60) for driving said rollers in rotation.

20. Device according to claim 19, characterised in that at least one of said rollers (64) is driven in rotation by said belt (56).

21. Device according to claim 1, characterised in that said detection means (72) include a detector (78) arranged in proximity to said grasping means (42).

* * * * *